US011207561B1

(12) United States Patent
Stevenson, III et al.

(10) Patent No.: US 11,207,561 B1
(45) Date of Patent: Dec. 28, 2021

(54) PORTABLE PUSHUP GRIPS

(71) Applicants: James Oliver Stevenson, III, Sacramento, CA (US); Michelle Cynthia Lau, West Sacramento, CA (US)

(72) Inventors: James Oliver Stevenson, III, Sacramento, CA (US); Michelle Cynthia Lau, West Sacramento, CA (US)

( * ) Notice: Subject to any disclaimer, the term of this patent is extended or adjusted under 35 U.S.C. 154(b) by 0 days.

(21) Appl. No.: 16/907,274

(22) Filed: Jun. 21, 2020

(51) Int. Cl.
*A63B 23/12* (2006.01)
*A63B 21/068* (2006.01)
*A63B 21/055* (2006.01)

(52) U.S. Cl.
CPC ..... *A63B 23/1236* (2013.01); *A63B 21/0557* (2013.01); *A63B 21/068* (2013.01); *A63B 2210/50* (2013.01)

(58) Field of Classification Search
CPC ..... A63B 23/1236; A63B 21/0557; A63B 21/068; A63B 2210/50; A63B 2208/0295
See application file for complete search history.

(56) References Cited

U.S. PATENT DOCUMENTS 5,205,802 A * 4/1993 Swisher ..... A63B 21/00047 482/100
6,186,930 B1 * 2/2001 Ignaczak ..... A63B 23/12 482/141
7,468,025 B2 * 12/2008 Hauser ..... A63B 21/00047 482/141
8,157,713 B1 * 4/2012 Siskowic ..... A63B 21/0004 482/141
9,526,942 B2 * 12/2016 Mills ..... A63B 21/00047
2007/0010375 A1 * 1/2007 Corte ..... A63B 1/00 482/41
2010/0317496 A1 * 12/2010 Abranchess ..... A63B 21/4035 482/141
2011/0077136 A1 * 3/2011 Tozzi ..... A63B 22/203 482/141
2011/0230313 A1 * 9/2011 Gamboa ..... A63B 23/03541 482/51
2014/0066274 A1 * 3/2014 Kassel ..... A63B 21/4035 482/141
2014/0087925 A1 * 3/2014 Dupuis ..... A63B 23/1236 482/97
2014/0357459 A1 * 12/2014 Izzo ..... A63B 21/4035 482/141
2015/0367170 A1 * 12/2015 Robertson ..... A63B 21/00065 482/139
2019/0314671 A1 * 10/2019 Abbott ..... A63B 21/1636
2020/0324165 A1 * 10/2020 Sasano ..... A63B 23/1236
2021/0178216 A1 * 6/2021 Ducato ..... A63B 21/4035

* cited by examiner

*Primary Examiner* — Andrew S Lo

(57) ABSTRACT

The present invention is described as one set containing a pair of pushup grips. Each grip includes a longitudinal hand support connected to two separate base supports. Each base support has a spring-loaded connection mechanism for rotation between a compact storage position and an active engaged position. The base supports are identical configurations, with a channel through the top of the length for the storage position, a channel through the top of the width for the active position, with a dampening tread covering the bottom of each base support. The longitudinal hand support optionally includes padding for added hand comfort and ring connectors on each end cap to attach to a resistance band.

7 Claims, 7 Drawing Sheets

PORTABLE PUSHUP GRIPS

BACKGROUND OF THE INVENTION

1. Field of the Invention

This invention relates generally to exercise equipment. Specifically, this invention relates to portable pushup hand grips.

2. Related Art

Exercise is at an all-time high, with a growing trend toward exercise as a social activity. Fitness centers, gyms, and exercise classes are commonplace in almost any location. A main staple of exercise routines—one of the most common exercises—is the pushup. Popularity of the pushup is evidenced by the plethora of pushup grips currently on the market. Prior art focuses on enabling an improved hand position off the ground to prevent strain on the wrists. Often the grips are also designed to enable an enhanced exercise using rotation or resistance. The problem with the prior art is the bulkiness and size of the grips. For those wishing to travel or wanting to use their own equipment for classes, the prior art grips are not appropriately sized or configured for convenient mobility and transport.

SUMMARY OF THE INVENTION

Portable pushup grips are described herein. The present invention is described as one set containing a pair, or two, of the pushup grips—one for each hand. Each grip includes a longitudinal hand support connected to two separate base supports. Each base support has a spring-loaded connection mechanism for rotation between a compact storage position and an active engaged position. The base supports are identical configurations, with a channel through the top of the length for the storage position, a channel through the top of the width for the active position, and a dampening tread covering the bottom of each base support. The longitudinal hand support optionally includes padding for added hand comfort and ring connectors on each end cap to attach to a resistance band.

DETAILED DESCRIPTION

Figure 1:
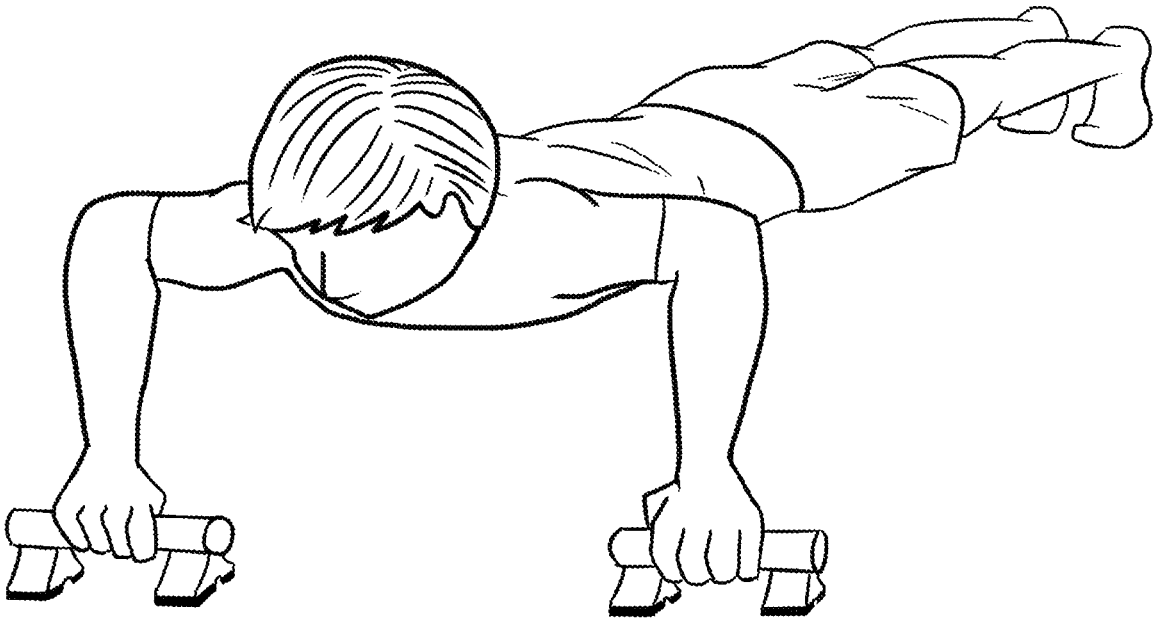
FIG. 1 illustrates a pair of portable pushup grips in use.

The present invention includes a set of pushup grips that are designed to be compact and portable. The disclosed invention comprises a first and a second pushup grip to form a pair of grips used for traditional pushup exercises as illustrated in FIG. 1, but the grips may be used singularly for one-armed pushup exercises. The first and second grips are identical and, as such, will hereinafter be described as a singular pushup grip.

Figure 2:
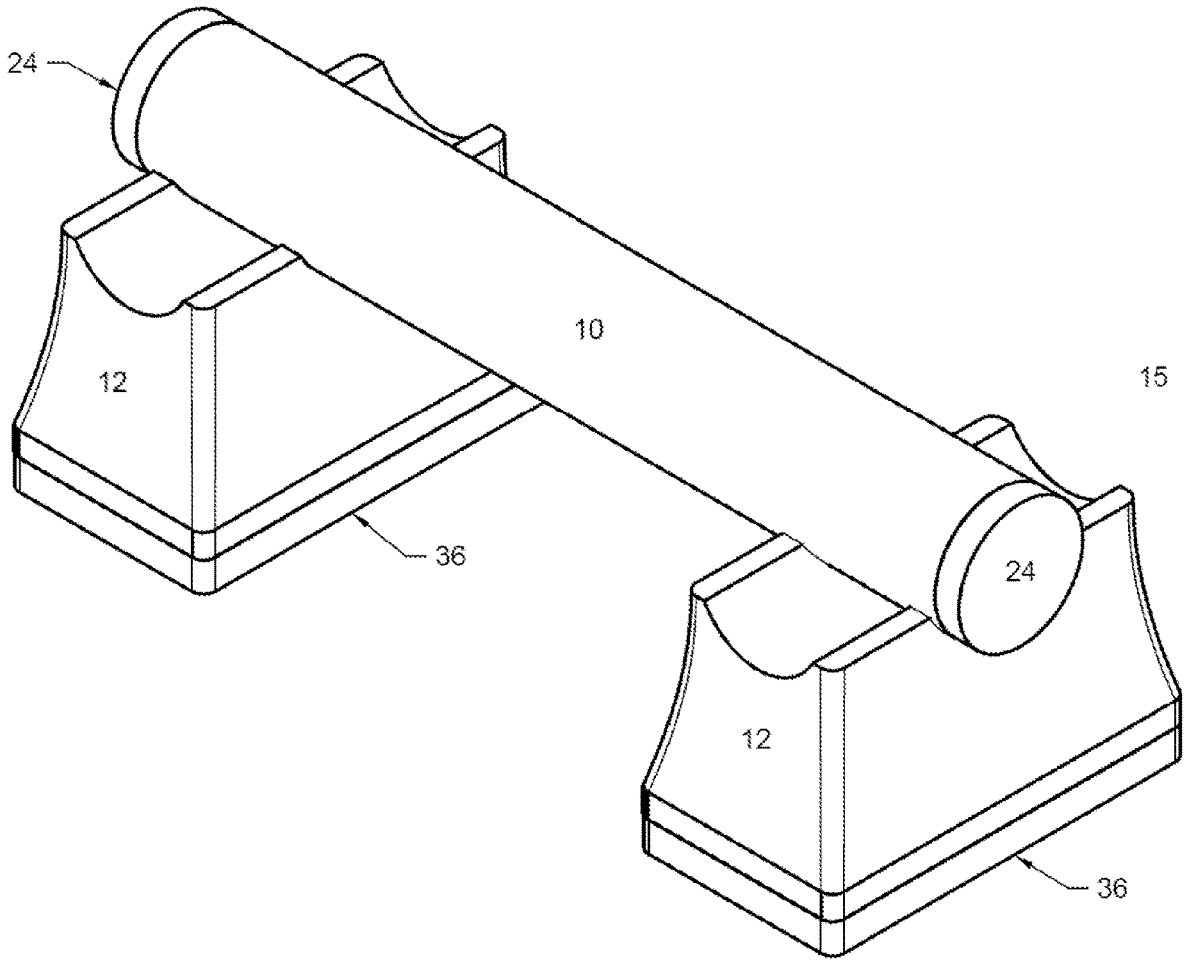
FIG. 2 illustrates a singular pushup grip in the active position.
Figure 3:
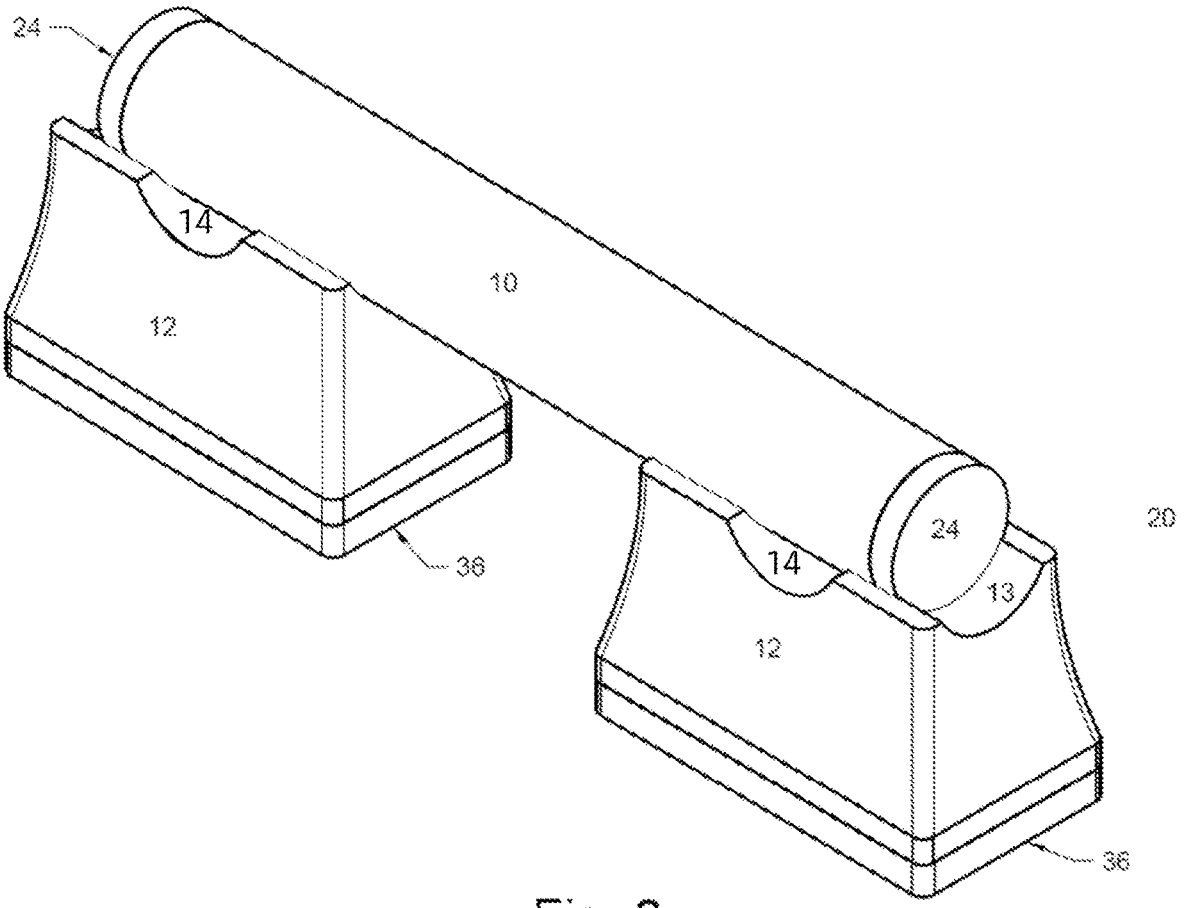
FIG. 3 illustrates a singular pushup grip in the compact position.

As shown in FIG. 2, each pushup grip has a longitudinal hand support 10 that has two identical base supports 12. Each base support 12 moves from an engaged active position 15 as illustrated in FIG. 2 to a compact storage position 20 as illustrated in FIG. 3. Each base support 12 has a first channel 13 through the top side of its length, enabling the hand support 10 to rest horizontally in the first channel 13 of the base support 12 to form the compact storage position 20. The base support 12 has a second channel 14 through the top side of its width, enabling the hand support 10 to rest horizontally in the second channel 14 of the base support 12 to form the engaged active position 15. The base support 12 rotates between the compact storage position 20 and the engaged active position 15 by pulling on the base support 12 and rotating the base until it rests in the respective channel of the desired position, either the engaged active position 15 or the compact storage position 20.

Figure 4:
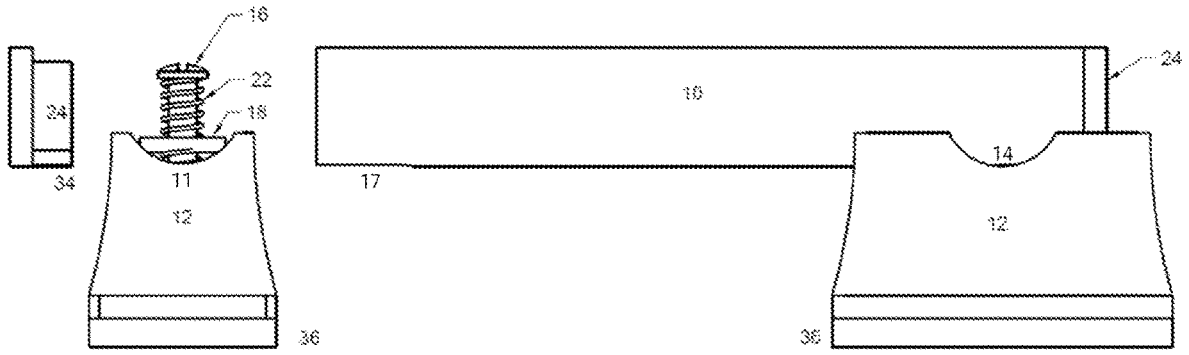
FIG. 4 illustrates the assembly.
Figure 5:
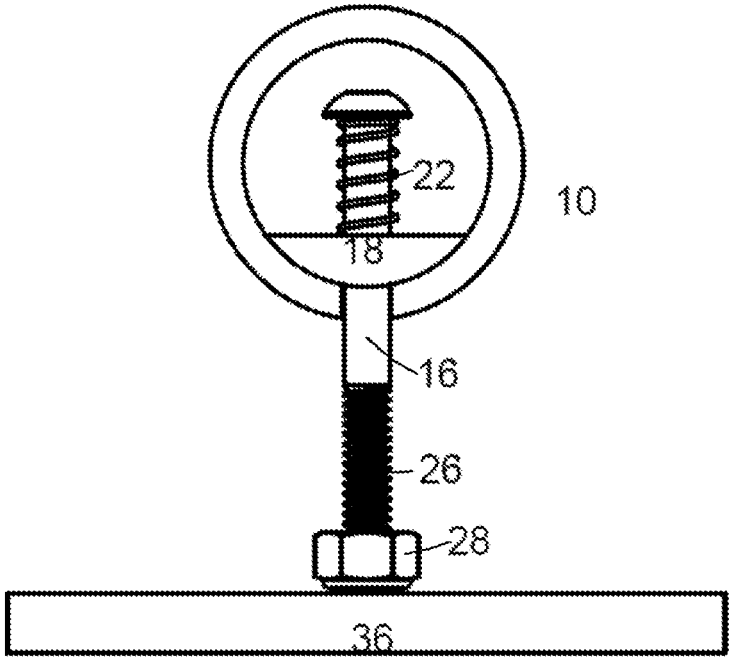
FIG. 5 illustrates the spring-loaded connection.
Figure 6:
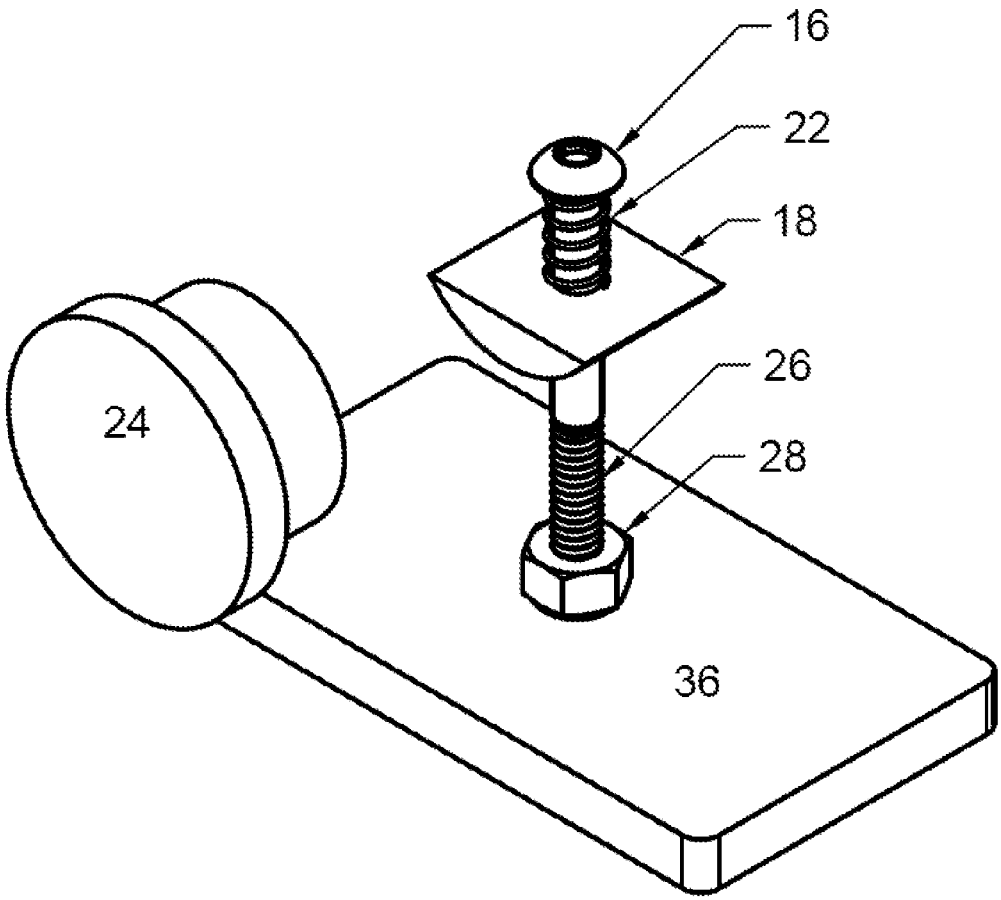
FIG. 6 illustrates the base support tread.

Each base support 12 is connected at an end of the hand support 10 by a spring-loaded connection mechanism 16, as shown in FIGS. 4-6. The connection mechanism 16 extends into an aperture at the bottom center of the base support 12 through its entirety and protrudes out an aperture 11 at the top center of the base support. The connection mechanism 16 extends into an end slit 17 at the bottom the hand support 10 to the top interior of the hand support, with a spring 22 and a stabilizing component 18 sitting at the interior of the hand support 10, and threading 26 and a nut 28 located within the base support 12. The stabilizing component 18 may be a washer or a custom molded piece that helps secure the hand support 10 onto the base support 12. The end slit 17 is located at the bottom of each end of the hand support to allow for sliding the connection mechanisms into place during assembly, as shown in FIG. 5. There is a cap 24 with a securing protrusion 34 at each end of the hand support 10 that fits snugly within the interior of the hand support to a depth that would press against the stabilizing component 18 to secure the position.

Figure 7:
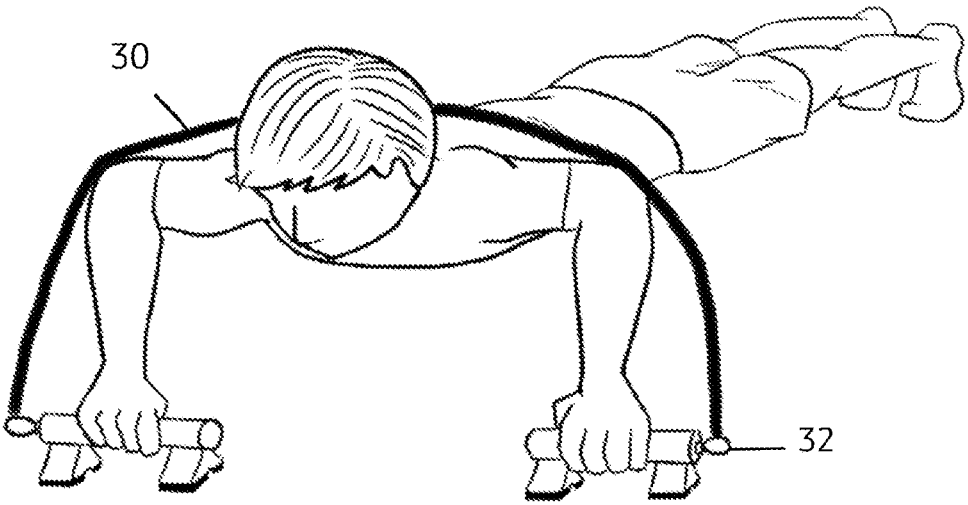
FIG. 7 illustrates an optional ring at the ends to attach to a tensioning apparatus.

The preferred embodiment of the hand support is cylindrical and hollow for lightweight comfort, but may also take other geometric forms and be of a solid configuration. As shown in FIG. 7, the pushup grips may be used in combination with a tensioning band 30 for resistance exercises, wherein each hand support 10 includes a connector ring 32 at the outside end of the cap 24. An elastic band 30 may be attached to the connector ring 32 at the outside of each hand support 10 for resistance training. Each connector ring 32 must be strong enough to support tension from a resistance band. The preferred embodiment of such a connector is a metal ring, but may also include a rope component. The end caps 24 are glued to the inside of the hand support 10 and may additionally or alternatively have outside threading to secure to inside threading of the hand support 10.

The preferred embodiment of the base supports 12 has a longer length than a shorter width, as shown in FIGS. 2-3, having a bottom portion of the base support that is wider than the top portion. The preferred embodiment also includes a rubber or foam tread piece 36 at the bottom of the base support to prevent slippage and also provide cushioning, with a soft or hard grip made of a type of foam, rubber, or plastic covering the hand support for added comfort.

What is claimed is:

1. An exercise apparatus comprising:

a longitudinal hand support with a first end and a second end and a top side and a bottom side, wherein said bottom side has a first slit starting at said first end and a second slit starting at said second end;

a first base support with a first center, a first top side, and a first bottom side, wherein said first base support is connected at said first center to said first end of said longitudinal hand support by a first spring-loaded connection that protrudes through a first aperture of said first center of said first base support into said longitudinal hand support;

wherein said first base support has a first length channel along said first top side wherein said longitudinal hand support can rest in said first length channel to form a compact storage position;

wherein said first base support has a first width channel along said first top side wherein said longitudinal hand support can rest in said first width channel to form an active engaged position;

wherein said first base support is rotatable between said compact storage position and said active engaged position;

a second base support with a second center, a second top side, and a second bottom side, wherein said second base support is connected at said second center to said second end of said longitudinal hand support by a second spring-loaded connection that protrudes through a second aperture into said longitudinal hand support;

wherein said second base support has a second length channel along said second top side wherein said longitudinal hand support can rest in said second length channel to form said compact storage position;

wherein said second base support has a second width channel along said second top side wherein said longitudinal hand support can rest in said second width channel to form said active engaged position;

wherein said second base support is rotatable between said compact storage position and said active engaged position;

a first end cap with a first inner portion and a first outer portion, wherein said first inner portion of said first end cap fits inside said first end of said longitudinal hand support and said first end cap is secured in place with an epoxy glue; and a second end cap with a second inner portion and a second outer portion, wherein said second inner portion of said second end cap fits inside said second end of said longitudinal hand support and said second end cap is secured in place with an epoxy glue.

2. The exercise apparatus according to claim 1, wherein said first and second spring-loaded connections each comprises a screw component, a spring, threading, and a stabilizing component.

3. The exercise apparatus according to claim 2, wherein said spring and said stabilizing component are confined within said longitudinal hand support.

4. The exercise apparatus according to claim 1, further comprising a first tread piece at said first bottom side of said first base support and a second tread piece at said second bottom side of said second base support.

5. The exercise apparatus according to claim 1, wherein said first end cap further comprises a connector ring at said first outer portion of said first end cap.

6. The exercise apparatus according to claim 5, comprising a pair of said exercise apparatuses, wherein a resistance band is attached to said first end caps.

7. The exercise apparatus according to claim 1, further comprising a hand grip made of a type of foam, rubber, or plastic, and wherein said grip covers said top side of said longitudinal hand support.

* * * * *